US009873144B2

(12) United States Patent
Ostheimer et al.

(10) Patent No.: US 9,873,144 B2
(45) Date of Patent: Jan. 23, 2018

(54) REEL FOR WINDING METAL STRIP

(71) Applicant: PRIMETALS TECHNOLOGIES AUSTRIA GMBH, Linz (AT)

(72) Inventors: Pascal Ostheimer, Linz (AT); Juergen Schiefer, Allhaming (AT)

(73) Assignee: PRIMETALS TECHNOLOGIES AUSTRIA GMBH (AT)

( * ) Notice: Subject to any disclaimer, the term of this patent is extended or adjusted under 35 U.S.C. 154(b) by 94 days.

(21) Appl. No.: 14/771,996

(22) PCT Filed: Feb. 17, 2014

(86) PCT No.: PCT/EP2014/053011

§ 371 (c)(1),
(2) Date: Sep. 1, 2015

(87) PCT Pub. No.: WO2014/131640

PCT Pub. Date: Sep. 4, 2014

(65) Prior Publication Data

US 2016/0016213 A1 Jan. 21, 2016

(30) Foreign Application Priority Data

Mar. 1, 2013 (EP) ..... 13157392

(51) Int. Cl.
*B65H 18/10* (2006.01)
*B21B 1/22* (2006.01)
(Continued)

(52) U.S. Cl.
CPC ..... *B21B 1/22* (2013.01); *B21C 47/28* (2013.01); *B65H 18/026* (2013.01); *B65H 18/10* (2013.01);
(Continued)

(58) Field of Classification Search
CPC ..... B21B 1/22; B21C 47/28; B65H 18/10; B65H 18/026; B65H 75/242; B65H 75/245
See application file for complete search history.

(56) References Cited

U.S. PATENT DOCUMENTS 3,104,074 A * 9/1963 Karr ..... B65H 75/243 242/571.1
3,236,471 A * 2/1966 Hornbostel ..... B65H 18/20 100/162 R
(Continued)

FOREIGN PATENT DOCUMENTS

CN 85106161 A 3/1987
CN 202377307 U 8/2012
(Continued)

OTHER PUBLICATIONS

International Search Report dated Jun. 18, 2014 issued in corresponding International patent application No. PCT/EP2014/053011.
(Continued)

*Primary Examiner* — Sang Kim
(74) *Attorney, Agent, or Firm* — Ostrolenk Faber LLP

(57) ABSTRACT

A reel for winding metal strip, in particular rolled hot strip, having a mandrel shaft (2), which has a first shaft end piece (18), which is rotably mounted by means of at least one bearing (4) provided in the machine frame (3) of the reel, a clamping device (5) arranged between the at least one bearing (4) and the mandrel shaft (2), such that, in a clamped operating state, a frictional connection can be produced between the at least one bearing (4) and the mandrel shaft (2).

9 Claims, 4 Drawing Sheets

(51) Int. Cl.
*B21C 47/28* (2006.01)
*B65H 18/02* (2006.01)

(52) U.S. Cl.
CPC ..... *B21B 2001/225* (2013.01); *B65H 2301/4132* (2013.01)

(56) References Cited

U.S. PATENT DOCUMENTS 3,592,405 A * 7/1971 Young ..... B65H 75/243 242/571.2
3,904,144 A * 9/1975 Gattrugeri ..... B65H 75/243 242/571.2
3,989,202 A 11/1976 Noé et al.
4,201,352 A * 5/1980 Madachy ..... B21C 47/006 242/419.4
6,360,982 B1 * 3/2002 Poppinghaus ..... B21B 29/00 242/539
2008/0237388 A1 * 10/2008 Klinke ..... B65H 75/243 242/571.1

FOREIGN PATENT DOCUMENTS

CN 202638954 U 1/2013
FR 2610910 A1 8/1988
FR 2610910 B1 2/1990
JP S 54-83653 7/1979

OTHER PUBLICATIONS

Written Opinion dated Jun. 18, 2014 issued in corresponding International patent application No. PCT/EP2014/053011.
First Office Action dated Apr. 1, 2016 in corresponding Chinese Patent Application No. 201480011900.4 with Search Report (English language translation)(12 total pages).

* cited by examiner

FIG 4
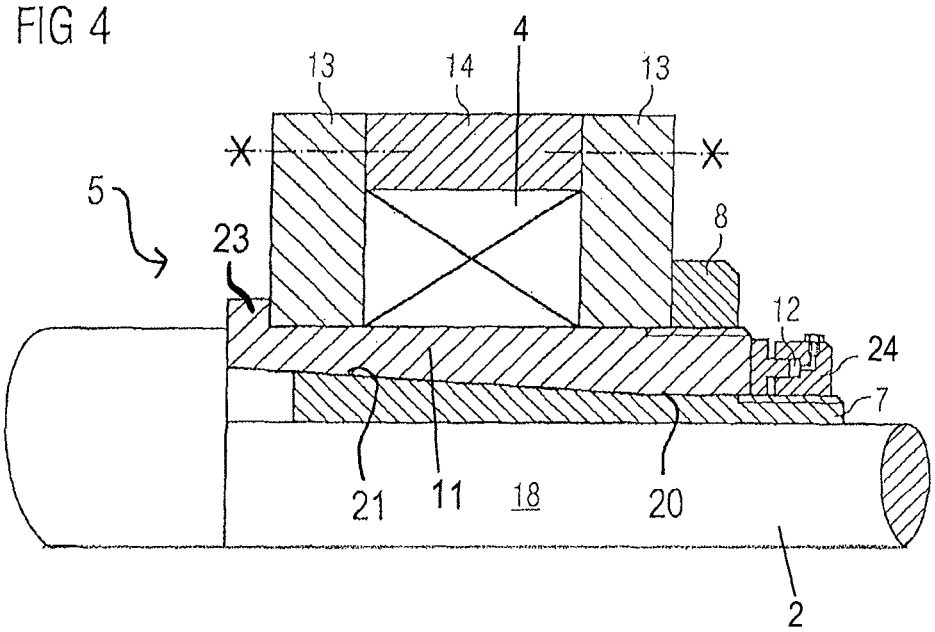
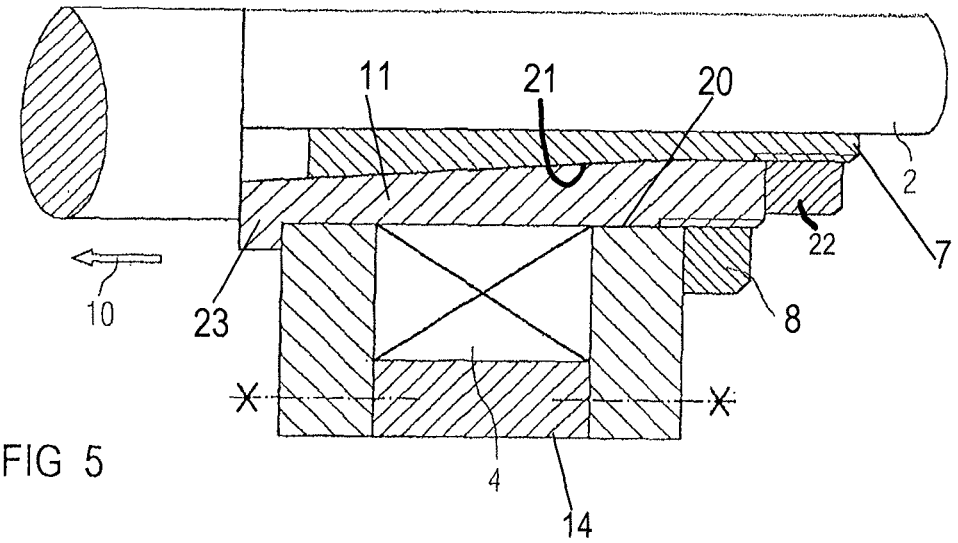
FIG 5

REEL FOR WINDING METAL STRIP

CROSS-REFERENCE TO RELATED APPLICATIONS

The present application is a 35 U.S.C. §§ 371 national phase conversion of PCT/EP2014/053011, filed Feb. 17, 2014, which claims priority of European Patent Application No. 13157392.5, filed Mar. 1, 2013, the contents of which are incorporated by reference herein. The PCT International Application was published in the German language.

TECHNICAL FIELD

The invention relates to a reel for winding metal strip, in particular hot-rolled strip, having a mandrel shaft which has a first shaft end piece which is rotatably mounted by means of at least one bearing provided in the reel frame.

PRIOR ART

When producing sheet steel, a hot-rolled metal strip passes through a roll stand or a mill train, including a plurality of roll stands, for the purpose of reducing the thickness of the hot-rolled metal strip. In order to wind the metal strip into a so-called coil, a reel is provided at the outlet of the rolling device. Such a reel has a mandrel shaft driven by a drive. The mandrel shaft is generally rotatably mounted in the machine frame of the reel by a plurality of bearings. The hot-rolled strip is wound onto the end of the mandrel shaft protruding from the machine frame on the operating side.

The mandrel shaft itself generally comprises a mandrel body, segments and an expanding rod which is axially movable in the mandrel body, whereby the segments are able to be expanded in the radial direction. The part of the mandrel shaft on the drive side which is mounted in the machine frame is coupled at its end to a rotary drive. The wound coils may then be removed in the axial direction, for example by a carriage which moves the coil out of the region of the reel.

During the production process, it may be necessary for the mandrel shaft to be changed. Changing a reel mandrel for the hot-rolled strip is time-consuming and requires the winding process be interrupted. The interruption may last several hours. In this case, the heavy reel mandrel for the hot-rolled strip has to be lifted from the reel by a suitable lifting tool. A reel mandrel for the hot-rolled strip may weigh more than 10 t, which makes a correspondingly large lifting tool necessary, with high capital expenditure. The maneuvering of the lifting tool in the region of the reel is awkward as space conditions are often very limited.

DESCRIPTION OF THE INVENTION

It is an object of the invention to provide a reel for which it is possible to change the mandrel shaft in a manner which is comparatively more rapid and simple and at a lower cost in terms of technical equipment.

According to a basic concept of the invention, the part of the mandrel shaft on the drive side is to be fastened in the bearing by means of a releasable clamping device. As a result, with the clamping device released, it is possible to pull the mandrel shaft in the axial direction out of the frame of the reel in a simple manner. Conversely, a new mandrel shaft may be inserted into the bearing from the operating side via the coil carriage. As soon as the new mandrel shaft is fully inserted into the machine frame, the clamping device is tensioned. As a result of this clamping of the shaft-hub-connection, a tangential direction frictional connection is produced between the mandrel shaft and the bearing, more specifically with the inner race of the bearing. The mandrel shaft is then fixed in the machine frame and is ready for winding on the hot-rolled strip.

The clamping device may be designed differently in terms of structure. Depending on the type of its actuation, it may be actuated both mechanically and hydraulically.

In one preferred embodiment, the clamping device is configured as a hydraulically actuated clamping sleeve. In a preferred design, it comprises a hollow space e.g. in the form of a hollow cylinder provided for receiving a hydraulic medium. If this hollow space is subjected to hydraulic pressure, it leads to radial widening of the clamping sleeve and, as a result, radial expansion in the region of the bearing seat forming the tangential frictional connection with the bearing and the mandrel shaft. This frictional connection may be released again by reducing the hydraulic pressure, and the resilient deformation of the clamping sleeve is reduced.

In a second embodiment, the clamping may take place by means of a mechanical clamping sleeve. In this case, the clamping force is manually produced, for example by a shaft nut in combination with a conical seat-conical bush construction.

In a further preferred embodiment of the invention, the clamping may be implemented by means of a combination of a hydraulic clamping sleeve in cooperation with a manually actuated conical seat-conical bush construction.

BRIEF DESCRIPTION OF THE DRAWINGS

For a further explanation of the invention, reference is made to the drawings in the following part of the description, further advantageous embodiments, details and developments of the invention being able to be derived therefrom, with reference to non-limiting exemplary embodiments, in which:

FIG. 4 shows an upper partial section of a further variant of the invention in which the clamping device as is configured from a combination of a hydraulic shaft nut and a mechanical clamping sleeve and;

FIG. 5 shows a lower partial section, of a mechanical shaft nut-clamping device.

DESCRIPTION OF EMBODIMENTS OF THE INVENTION

Figure 1:
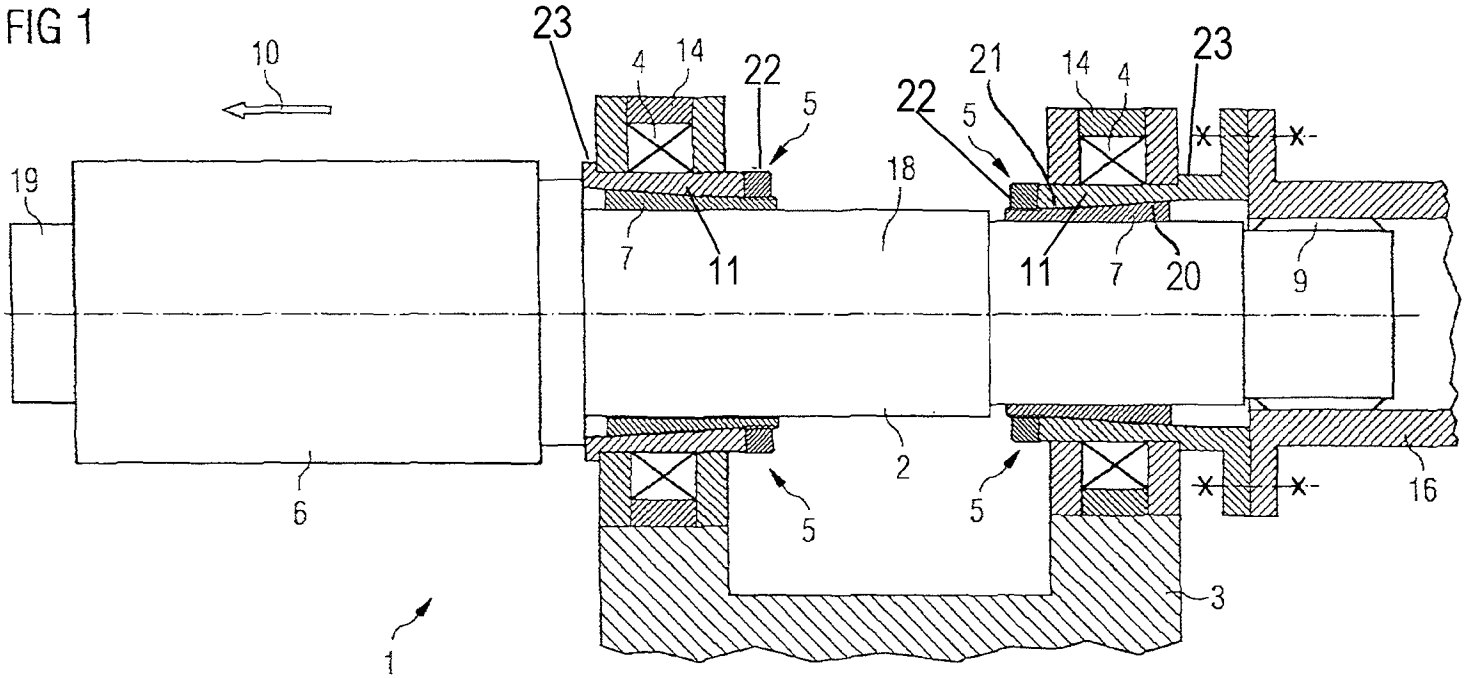
FIG. 1 shows a schematic view of a bearing and a clamping device of the mandrel shaft according to the invention in the machine frame of a reel.

FIG. 1 shows parts of a reel 1 in a very simplified view. The reel 1 has a mandrel shaft 2 which is rotatably mounted in a machine frame 3 in a part 18 on the drive side by means of two bearings 4. These two bearings 4 may, for example, be rolling bearings which in each case have an inner race and an outer race, wherein the outer race is fastened in the machine frame 3 by an interference fit or by being supported on the bearing half-shells 14.

The part of the mandrel shaft 2 on the operating side, which protrudes from the machine frame 3 on the left-hand side in FIG. 1, contains an expansion device for winding the hot-rolled strip to form a coil 6. A support bearing 19 supports the outer left-hand end of the mandrel shaft 2.

The mandrel shaft 2 is driven by a drive, not shown in more detail, via the drive part 16 which is connected to the mandrel shaft 2 by means of a coupling, for example a releasable, positive connection, for example in the form of a toothing 9. The positive connection may also be designed differently, for example an interlocking spline-shaft-spline-hub profile. The torque required for the winding process, therefore, is substantially transmitted via this coupling.

According to the invention, the connection between the mandrel shaft 2 and the inner race of each respective bearing 4 is a releasable connection which is produced by a clamping device 5. The clamping device 5 is constructed such that, in a clamped state, a mandrel shaft 2 inserted into the bearing 4 may be fixed by a tangential direction frictional connection described below. To this end, radial widening is produced in the region of the bearing seat by the clamping device 5, until it is ensured that the mandrel shaft 2 and the inner race of the bearing 4 do not slip relative to one another.

Embodiments of mechanically actuated clamping devices 5 are illustrated in FIGS. 1, 4 and 5. Each embodiment comprises at least one and more usually two bearings 4 supported in a housing 14 secured in a machine frame (not shown).

A bush 11 at the radially inward side of each bearing 4 is supported by the bearing in the axial position of the bush along the shaft 2.

Each bush 11 includes a collar 23 at one end of the bush that engages the bearing cover 13. A shaft nut 8 is threaded on the other end region of the bush and when tightened on the bush, the nut 8 and the collar 23 prevents the bearing 4 from moving axially with respect to the bush, and vice versa. Since the bearing outer race is fastened in the machine frame, the bush is also prevented by the bearing and the frame from moving axially.

A respective mechanical clamping sleeve or conical seat 7 is located at and radially inward of each bush 11 and of each of the two bearings 4 and is in contact with the exterior of the mandrel shaft 2. Each sleeve or seat 7 has an outward facing, conically inclined surface 20 which contacts a complementary inward facing, conically inclined surface 21 of the respective axially stationary bush 11 which is at the inward side of each bearing 4. The conical inclined surfaces are inclined in a direction along the axis of the shaft. The inclined surfaces are preferably both axially and radially complementary. Because of the complementary conical inclines of the surfaces 20 and 21, the conically inclined surface of each seat and of the respective bush at each bearing 4 engage, and the inclines cause application or release of a radially directed force applied radially inwardly by both of the bush 11 and the seat 7 against the mandrel shaft 2 as the axial positions of the conical seats 7, are adjusted axially with respect to the non-moving bushes 11 and their bearings 4.

Only the sleeve or seat 7 is movable axially and not the bush or bearing. In FIGS. 1 and 5, the shaft nut 22 is attached at the end of the bush 11 and remains axially stationary along with the bush and the bearing. The shaft nut 22 is threaded on an end region of the seat 7. When the nut 22 is rotated, it moves the adjacent seat or conical sleeve 7 axially along the shaft for the clamping and releasing.

In the exemplary embodiment in FIG. 1, the two illustrated bush 11 and seat 7 combinations face in axially opposite directions. The bushes 11 and their respective bearings do not shift axially because they are fastened in the frame. Only the two seats 7 are moved by rotation of the nuts 22 to move the seats axially toward each other to increase the applied clamping force and are moved axially apart to release the clamping force. This movement selectively applies force radially for clamping the mandrel shaft to the bearing and or alternatively removes the force for releasing that clamping. The resultant clamping of the bushes and clamping of the seats to the mandrel shaft applies a necessary friction force in a tangential direction of the shaft between the mandrel shaft and the bearings to fix the mandrel shaft 2 in the bearings 4 for the shaft to rotate. Release of the clamping device 5 releases the radial clamping force, releases the frictional connection between the bearings 4 and the mandrel shaft 2 and frees the shaft 2 to be withdrawn from the bearings 4 in the axial direction so that the mandrel shaft 2 may be pulled out of the bearings and the machine frame 3 in the axial direction of the arrow 10 from the operating side.

Described below are the releasable shaft-hub frictional connections of FIGS. 2, 3 and 5. By the releasable shaft-hub frictional connections of all of FIGS. 1-5, which are able to be produced in a simple manner, it is possible to change the mandrel shaft 2 rapidly and easily with very little technical effort. A specific lifting tool is no longer required. It is possible to reduce the time which is otherwise required to change a mandrel, from approximately eight hours to approximately one to two hours. The changing process is simple and requires few personnel. The mandrel may be changed without changing bearings and expansion cylinders, whereby these elements are no longer required as replacement parts. In the region of the reel, space is no longer required for the lifting tool. Furthermore, testing of this device which otherwise has to be carried out on a regular basis may be dispensed with.

The actuation of the clamping device 5 may be effected in different ways. The actuation may take place, for example, hydraulically or mechanically.

Figure 2:
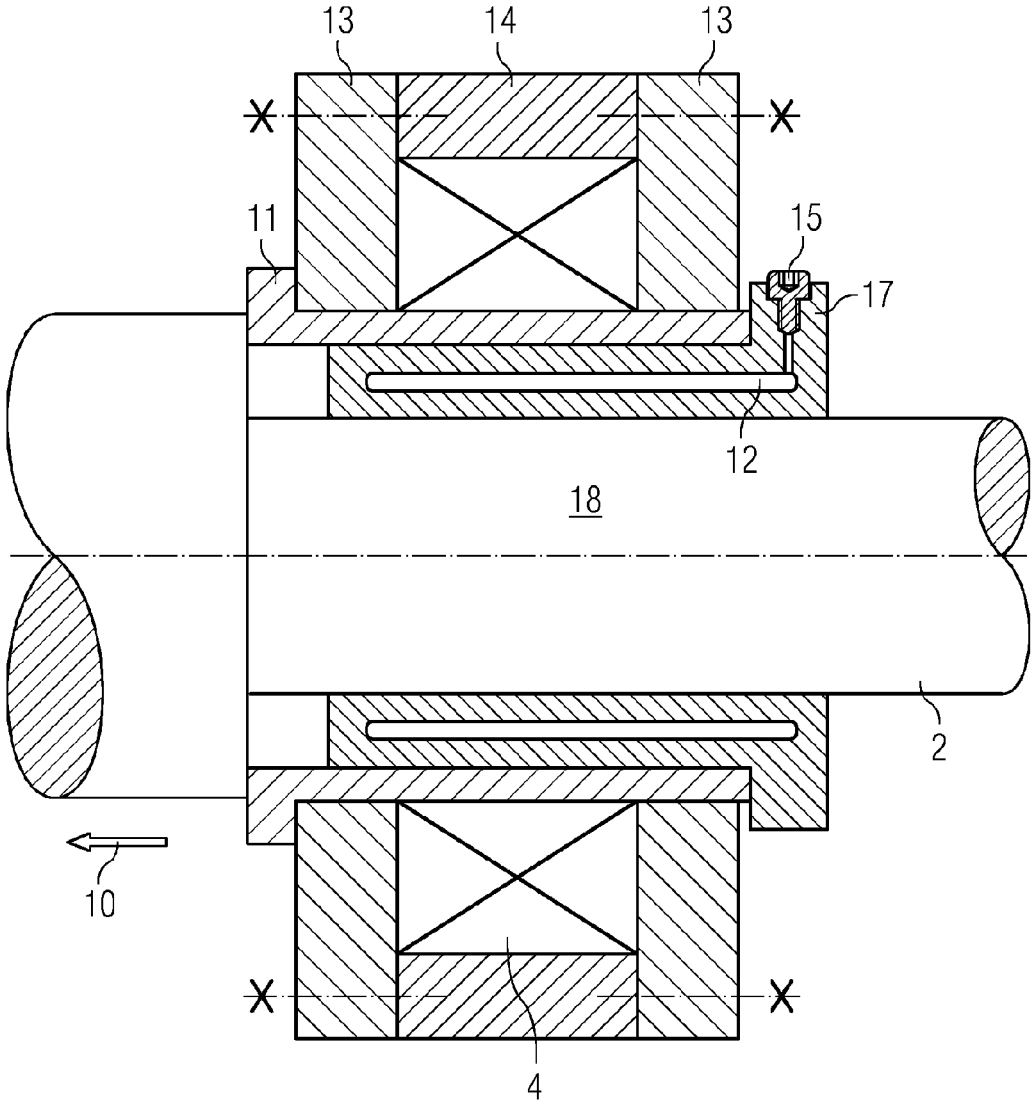
FIG. 2 shows a first exemplary embodiment of the invention in which the clamping device is configured as a hydraulic clamping sleeve.

FIG. 2 shows an embodiment in which a hydraulic clamping sleeve 17 is arranged on the end piece 18 on the drive side. This embodiment does not use a shifting sleeve or seat, unlike the seat 7 in FIGS. 1 and 5, to clamp the bearing to the shaft.

In FIG. 2, around its outer periphery, the hydraulic clamping sleeve 17 is surrounded by a bush 11 with a collar which in turn is enclosed by the inner race of the bearing 4. The bearing 4 is located on the outer periphery on a bearing half-shell 14. The two front faces of the bearing 4 are protected by a bearing cover 13 and a seal, not shown in more detail. A hollow space 12 is provided in the clamping sleeve 17. This hollow space has the shape of a hollow cylinder. It extends axially over the width of the bearing 4. The hollow space 12 is connected to a channel which leads to the outside and is closed by a closure 15. As a result, it is possible to introduce a pressurized hydraulic fluid, so that the annular parts of the clamping sleeve 17 which oppose one another in the hollow space 12 are subjected to radial widening. This may take place, for example, by attaching a pressure line connected to a hydraulic pump. The pressure in the hollow space results in the annular parts of the clamping sleeve 12 which oppose one another in the hollow space being moved away from one another slightly and a radially oriented pressure being produced between the shaft end piece 18 and the bearing 4. This pressure secures the mandrel shaft 2 in the bearing 4. When this connection is to be released, the hydraulic pressure is reduced in the hollow space 12. As a result, the annular parts of the clamping sleeve 12 which oppose one another in the hollow space move toward one another again. The pressure is released and the connection between the mandrel shaft 2 and the bearing 4 is released. The mandrel shaft 2 may be removed from the machine frame 3 of the reel in the axial direction toward the operating side.

Figure 3:
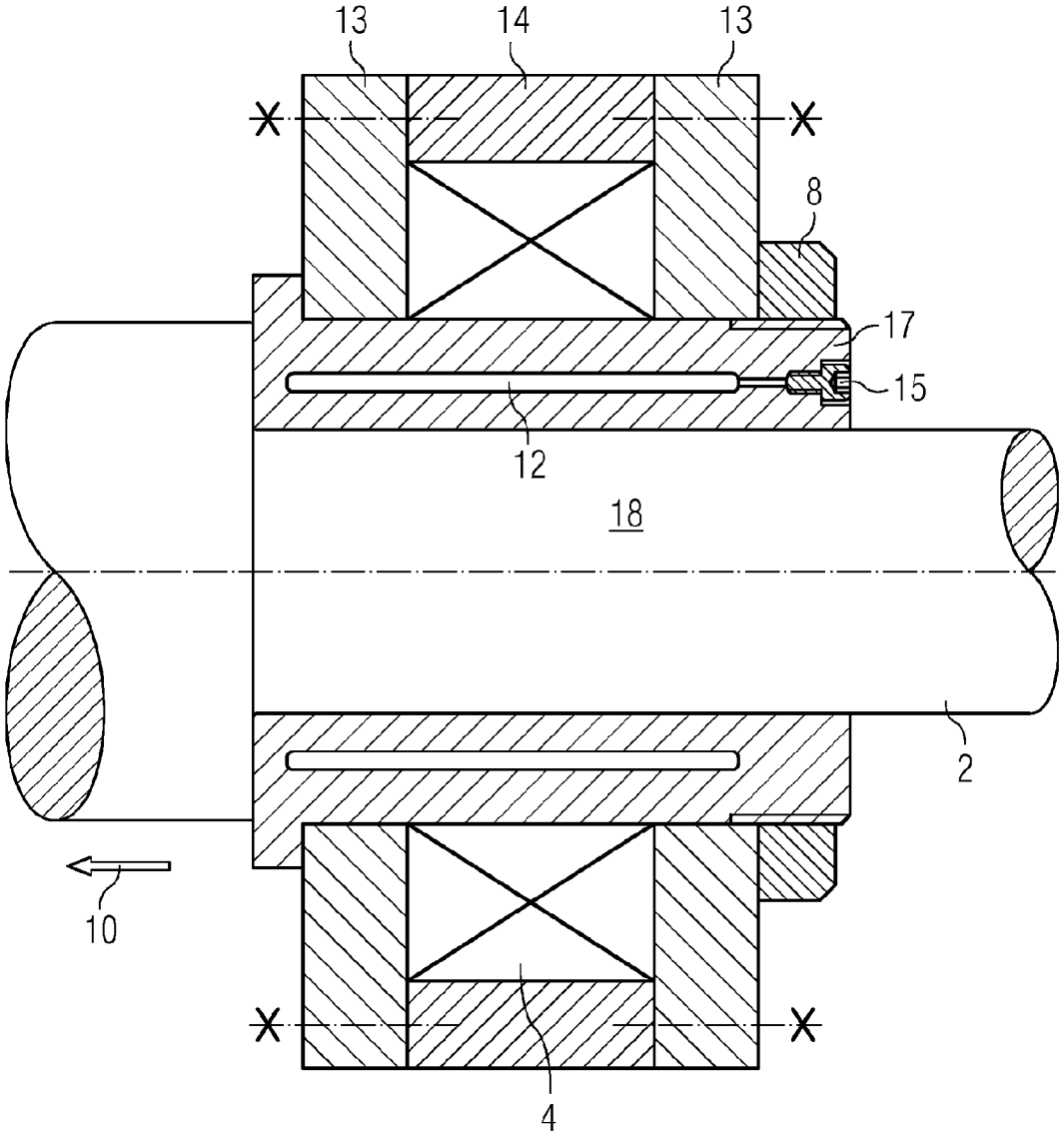
FIG. 3 shows a second exemplary embodiment of the invention in which the clamping device is configured as a combination of a hydraulic clamping device and a mechanical clamping device.

FIG. 3 shows an embodiment in which the clamping device 5 is also configured as a hydraulic clamping sleeve 17 or seat but acts directly, i.e. without the interposition of a bush, on the inner race of the bearing 4. Here the clamping sleeve 17 is fixed by a shaft nut 8 threaded on the sleeve because there is no bush. In contrast to FIG. 2, the connecting channel between the outer space and the hollow space 12 on the front face of the hydraulic clamping sleeve 17 is accessible from the outside. It is also closed by a closing screw 15.

FIGS. 4 and 5, discussed above show in the upper and lower partial section in each case a respective embodiment in which the frictional connection is produced by a conical seat with a conical bush.

In the upper partial section, of FIG. 4 actuation of the clamping takes place once again hydraulically, by the mechanical clamping sleeve or seat 7, which is located on the inside and against the shaft 18, being axially displaced with respect to the conical bush 11 surrounding the seat on the outer periphery. In FIG. 4, the bearing 4 is fixed in the machine frame and is fixed axially between the collar 23 at one end of the bush and the shaft nut 8 or hydraulic clamping sleeve threaded on the end region of the bush 11. The bearing and bush are fixed axially in the machine frame. In FIG. 4, the hydraulic clamping sleeve 24 is permanently fixed to the sleeve 7 and thus pushes itself together with the mechanical clamping sleeve 7 in an axial direction for either tightening or loosening the clamping mechanism between the shaft 18 and the bearing 4. Depending on the direction of the movement. The small piston of the hydraulic clamping sleeve 24 is attached to the bush 11. This clamping is thus produced both mechanically and hydraulically by the sleeve 24.

In the embodiment at the lower partial section of FIG. 5, the production of the tensioning force and/or clamping force is purely mechanical. In FIG. 5, there is the bush nut 8 to retain the bearing 4 fixed in the bush 11 and they are fixed in the machine frame. In FIG. 5, there is a shaft nut 22 which is attached to the axially stationary bush 11 and is also threaded on an end region of the seat 7. Rotation of the shaft nut 22 on the seat 7 moves the seat 7 axially on the shaft 2 for engaging or disengaging the clamping mechanism.

It is common to the two embodiments of FIGS. 4 and 5 that a force is produced once again in the radial direction, by means of which the mandrel shaft 2 may be fixed in the bearing 4 of the machine frame 3 by tangential friction and/or may be dismantled from the machine frame 3 by releasing the frictional connection.

An essential advantage of the invention is that by means of the clamping device a mandrel shaft 2 may be rapidly and easily mounted in and/or dismantled from a machine frame 3 of a reel 1. The time required to change a reel mandrel for a hot-rolled strip, which in known reels often requires the production time to be interrupted for six to eight hours, may be considerably reduced.

Although the invention has been illustrated and described in more detail by the preferred exemplary embodiments shown above, the invention is not limited by the examples disclosed and other variants may be derived therefrom by the person skilled in the art without departing from the scope of the invention.

LIST OF REFERENCE NUMERALS USED

1 Reel
2 Mandrel shaft
3 Machine frame
4 Bearing
5 Clamping device
6 Coil, hot-rolled coil
7 Mechanical clamping sleeve, conical seat
8 Shaft nut for bearing
9 Toothing
10 Direction of extraction
11 Bush
12 Hollow space
13 Bearing cover
14 Bearing half-shell
15 Closure
16 Drive piece
17 Hydraulic clamping sleeve
18 Shaft end piece
19 Support bearing
20 Surface of seat
21 Surface of bush
22 Shaft nut for bush and bearing
23 Collar on bush
24 Hydraulic clamping sleeve

The invention claimed is:

1. A reel for winding metal strip and hot-rolled strip comprising:
- a machine frame;
  - at least one bearing in the machine frame;
  - a mandrel shaft having a first shaft end piece which is rotatably mounted by the at least one bearing in the machine frame; and
  - a clamping device disposed between the at least one bearing and the mandrel shaft, the clamping device being configured and operable such that in a clamped operating state thereof, the clamping device produces a tangential frictional connection between the at least one bearing and the mandrel shaft,
  - wherein the clamping device is configured to be actuated hydraulically to produce the tangential frictional connection between the at least one bearing and the mandrel shaft.

2. The reel as claimed in claim 1, further comprising the clamping device has a hydraulically actuated clamping sleeve which is configured to apply radially directed force toward the mandrel shaft when the clamping sleeve is hydraulically activated.

3. The reel as claimed in claim 2, further comprising the hydraulically actuated clamping sleeve has a hollow cylinder in the clamping sleeve for receiving a hydraulic medium to hydraulically activate the clamping device.

4. The reel as claimed in claim 3, further comprising the hollow cylinder is configured to be accessible from outside the clamping device via a channel for conducting the hydraulic medium into the hollow cylinder.

5. The reel as claimed in claim 4, further comprising:
- the channel is configured to be closed from outside the clamping device; and a closure at the channel and configured for closing the channel.

6. The reel as claimed in claim 3, wherein the hollow cylinder has an axial extent that is wider than the axial width of the associated bearing.

7. The reel as claimed in claim 2, further comprising the hydraulically actuated clamping sleeve has a hollow cylinder in the clamping sleeve for receiving a hydraulic medium to hydraulically activate the clamping device.

8. The reel as claimed in claim 1, further comprising the shaft end piece is mounted in two of the bearings which are spaced apart along the mandrel shaft.

9. The reel as claimed in claim 1, further comprising a rotation drive for rotating the mandrel shaft.

* * * * *